United States Patent [19]

Fast

[11] Patent Number: 4,869,007

[45] Date of Patent: Sep. 26, 1989

[54] MERCHANDISE INFORMATION TAG FOR WIRE RACKS

[76] Inventor: Jacob Fast, 7561 NW. 9th St., Plantation, Fla. 33317

[21] Appl. No.: 150,199

[22] Filed: Jan. 29, 1988

[51] Int. Cl.[4] ..... G09F 3/14

[52] U.S. Cl. ..... 40/664; 40/617

[58] Field of Search ..... 40/663, 662, 664, 668, 40/316, 308, 642, 617; 248/221.4, 214, 202, 202.1, 203, 225.2, 308; 211/118

[56] References Cited

U.S. PATENT DOCUMENTS

| | | | |
|---|---|---|---|
| 1,866,554 | 7/1932 | Fairbanks | 40/617 |
| 2,923,078 | 2/1960 | Slavsky | 40/642 |
| 3,721,028 | 3/1973 | Lehner | 40/668 |
| 4,572,380 | 2/1986 | Langwell | 248/221.4 |
| 4,693,441 | 9/1987 | Conway | 248/225.1 |

*Primary Examiner*—Robert P. Swiatek
*Assistant Examiner*—Cary E. Stone
*Attorney, Agent, or Firm*—Fleit, Jacobson, Cohn, Price, Holman & Stern

[57] ABSTRACT

A merchandise information tag for use with a wire-type rack of a refrigerator or like case in supermarkets and other stores, has attachment elements enabling the tag to be suspended either from longitudinal front-to-back extending rods of the rack or to transverse rods, with the body of the tag still being oriented toward the front of the rack. The tag has suspension elements forward on fold-back tabs which enable the alternative suspension modes dependent on the orientation of the tabs.

7 Claims, 1 Drawing Sheet

MERCHANDISE INFORMATION TAG FOR WIRE RACKS

BACKGROUND OF THE INVENTION

This invention relates to merchandise information tags of the type which can be used for displaying information such as pricing and the like relating to merchandise which is stored on wire racks, in particular. For example, in refrigerator cases and the like of the type commonly used in supermarkets and like stores, merchandise is often stored on wire-type racks which may, for example, comprise an array of parallel wire rods extending lengthwise front to back of the case, or alternatively, may comprise a criss-cross array of wire rods extending both longitudinally and laterally.

It is an object of the invention to provide a product information tag which can be used with equal facility on wire-type racks of either of the above types, and which can be attached either on lengthwise back-to-front rods or on transverse rods in a manner whereby product information is presented to a viewer at the front of a rack.

Another object of the invention is to provide a tag of the above type which is simple and economical to manufacture and which can be readily applied and removed from a wire rack for convenient reuse in either of the above orientations.

Another object of the invention is to provide a tag of the type referred to which can be applied to substantially any rod of a wire rack, either a longitudinal or a transverse rod in substantially any position on the rack, and substantially without disturbing merchandise displayed thereon.

SUMMARY OF THE INVENTION

In accordance with the invention, a merchandise information tag for use on wire racks of the type referred to comprises a preferably rectangular sheet of plastic material, of a type commonly used for such tags, the sheet having an upper edge portion defining a pair of fold-back tabs at opposite edges of the tag and an elongate loop element extending from each tab for looping over a wire rod and self-attachment to the relevant tab. With this arrangement, when the fold-back tabs are maintained in the general plane of the rectangular tag body, the respective loop elements may be looped over the same wire rod, normally a transverse rod of a refrigerator case or the like whereby the product information on the tag body may be viewed from the front of the rack. Also, however, the respective tabs can be folded back substantially at right angles to the main body of the tag and the loop elements can then be looped over respective adjacent lengthwise extending back-to-front rods of a refrigerator rack or the like, again for viewing product information on the main body of the tag from the front of the rack.

The tag structure is accordingly extremely versatile in its uses by virtue of the different orientations in which the tabs and loop elements can be set.

For self-attachment of the loop elements to the respective tabs, upon looping over a wire rod or rods, each loop element may have an arrowhead-type formation at its terminal end which may be fitted in a transverse slit in the respective tab. Also, the main body of the tag may have cutout-type flaps for receiving and retaining a non-adhesive label or the like therebetween.

Additional features and embodiments of the invention will become apparent from the ensuing description and claims read in conjunction with the accompanying drawings.

BRIEF DESCRIPTION OF THE DRAWINGS

FIG. 2 is a perspective view of the tag attached to the forward most transverse rod of a first form of merchandise rack, for example, of a refrigerator case in a supermarket and the like;

DESCRIPTION OF THE PREFERRED EMBODIMENT

Figure 1:
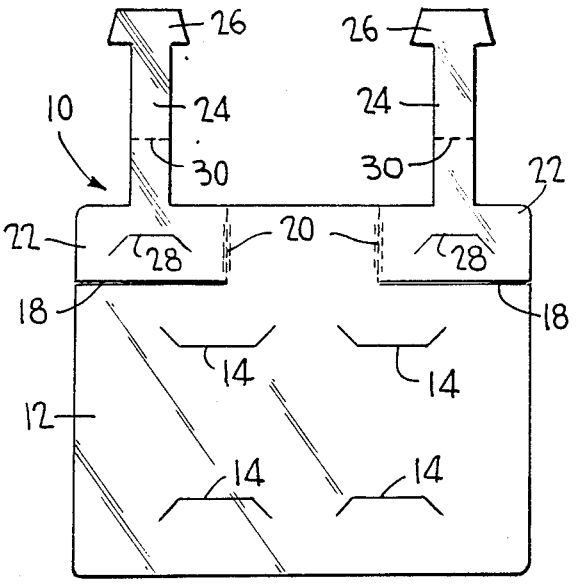
FIG. 1 is a front elevational view of a merchandise information tag in accordance with the invention.

Referring initially to FIG. 1, there is shown a merchandise information tag 10 which may, for example, be die-cut from suitable plastic sheet material, the tag having a generally planar and rectangular body portion 12 which may include pairs of vertically spaced flap-type cutouts 14 useful, for example, for attaching a nonadhesive label 16 or the like to a front face of the tag. The upper part of the tag is formed with a pair of transverse slits 18 which terminate at respective vertically extending bend lines 20 thereby defining respective fold-back tabs 22. Extending from each tab 22 is an elongate loop element 24 terminating in an arrowhead-shaped head 26. Each tab 22 further has a flap-type cutout 28 for receiving the arrowhead 26 when element 24 is looped over a wire rod as shown in the succeeding figures. To promote bending of the loop elements 24, these may be provided with transverse creases 30.

Figure 2:
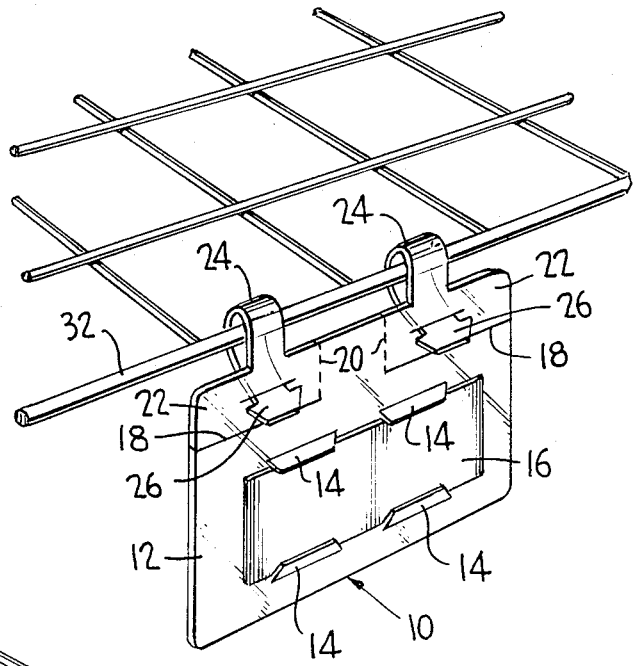
Figure 3:
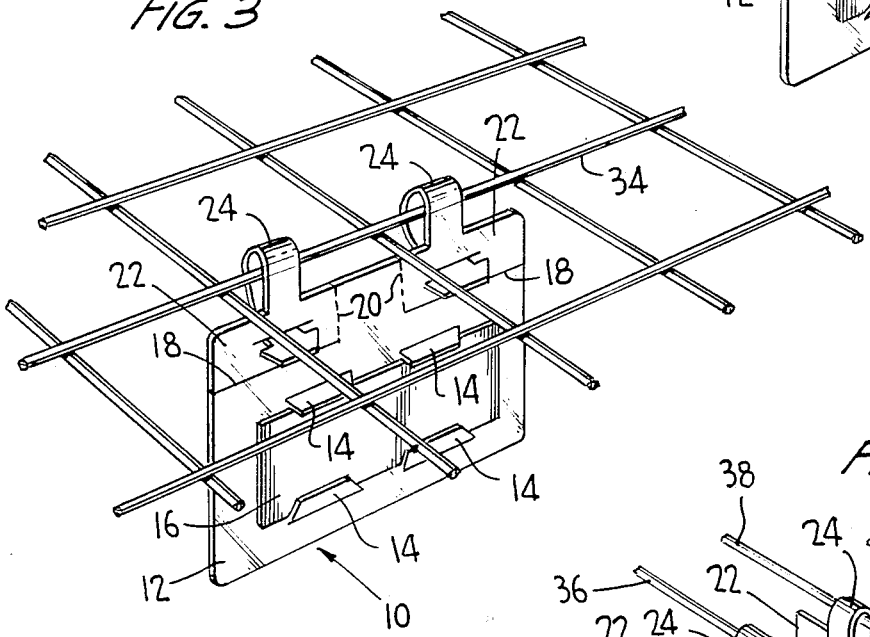
FIG. 3 is a view similar to FIG. 2 showing the tag attached to another transverse rod of the rack behind the forward most rod.
Figure 4:
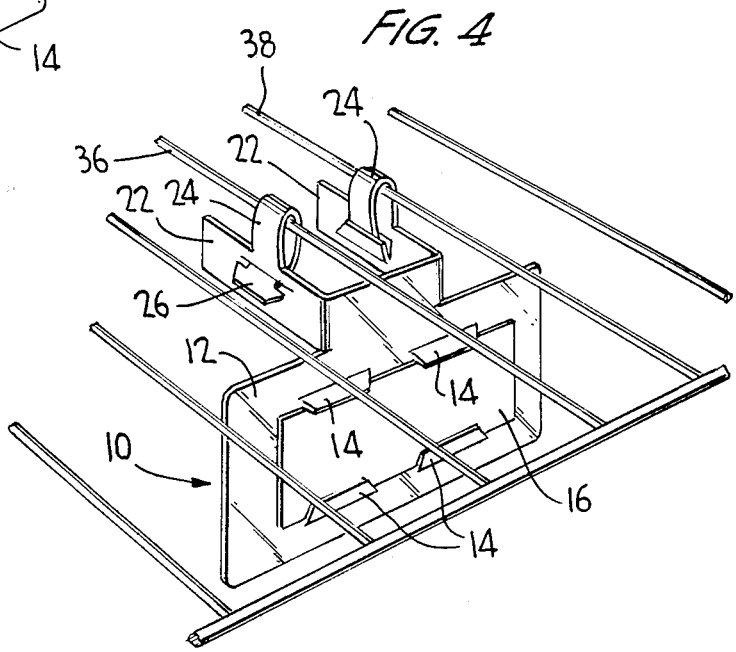
FIG. 4 is a perspective view of the tag in an alternative orientation whereby it is attached to longitudinal front-to-back extending rods of a different type of wire rack.

FIGS. 2-4 show different ways in which tag 10 may be used. Thus, as shown in FIG. 2, with the tabs 22 retained in the same plane as the body portion 12 of the tag, the loop elements 24 may be looped over the same rod 32, which may for example form the forward-most transverse rod of a criss-cross type wire rack in a refrigerator case of a supermarket or the like. Alternatively, as shown in FIG. 3, the tag, again with the tabs 22 retained in the same plane as body 12 may be attached to a different rod 34 of the rack by looping the elements 24 over the rod and pressing the respective arrowheads 26 through the respective slits 28.

FIG. 4 shows an arrangement in which the tag may be attached to two adjacent front-to-back extending rods 36, 38 of a wire rack which may of the type only having the front-to-back rods. In this arrangement, the tabs 22 are folded back substantially at right angles to the body portion 12 of the tag and the respective loop elements 24 are looped over the respective rods 36, 38 and attached as previously with the arrowheads and slits 26 and 28.

It is evident from the above that the tag structure in accordance with the invention is extremely versatile in its application and can be attached substantially wherever required on a wire rod-type rack of the type either having both transverse and longitudinal rods or of a type having only longitudinal rods. Moreover, in either form of attachment, the tag is orientated for viewing from the front of the rack.

While only a preferred embodiment of the invention has been described herein in detail, the invention is not limited thereby and modifications can be made within the scope of the attached claims.

What is claimed is:

1. A merchandise information tag for use on a wire rod-type rack of a refrigerator case and the like, the tag comprising a substantially planar body portion of sheet material having a height dimension, a width dimension, an upper edge portion defining a pair of fold-back tabs, fold means providing folding of the respective tabs about lines extending in a direction of said height dimension and a suspension element extending from an upper edge of each tab, said upper edge being perpendicular to said height dimension whereby when the tabs are in coplanar relation with the body portion, the suspension elements may each be secured to a common rod of a wire rack to suspend the tag from the rod, and when the tabs are folded back substantially at right angles to the body portion, the suspension elements may be secured to separate rods of a wire rack to suspend the tag therefrom.

2. The invention as defined in claim 1, wherein the body portion of the tag includes spaced label-holder flaps.

3. A merchandise information tag for use on a wire rod-type rack of a refrigerator case and the like, the tag comprising a substantially planar body protion of sheet material having an upper edge portion defining a pair of fold-back tabs and a suspension element extending from an upper edge of each tab whereby when the tabs are in coplanar relation with the body portion, the suspension elements may each be secured to a common rod or a wire rack to suspend the tag from the rod, and when the tabs are folded back substantially at right angles to the body portion, the suspension elements may be secured to separate rods of a wire rack to suspend the tag therefrom, wherein the suspension elements comprise respective elongate loop elements and respective attachment means between each loop element and the respective tab.

4. The invention as defined in claim 3, wherein the attachment means comprises a head formation on the end of a respective loop element and a head-receiving slit in the respective tab.

5. A merchandise information tag for use on a wire rod-type rack of a refrigerator case and the like, the tag comprising a substantially planar body portion of sheet material having an upper edge portion defining a pair of fold-back tabs and a suspension element extending from an upper edge of each tab whereby when the tabs are in coplanar relation with the body portion, the suspension elements may each be secured to a common rod of a wire rack to suspend the tag from the rod, and when the tabs are folded back substantially at right angles to the body portion, the suspension elements may be secured to separate rods of a wire rack to suspend the tab therefrom, wherein the tabs are defined by transverse slits extending from opposite side edges of the body portion and fold lines at inner ends of the respective slits.

6. In combination with a wire-type rack of a refrigerator case and the like, a merchandise information tag comprising a substantially planar body portion of sheet material having a height dimension, a width dimension, an upper edge portion defining a pair of fold-back tabs, fold means providing folding of the respective tabs about lines extending in a direction of said height dimension and a suspension element extending from an upper edge of each tab, said upper edge being perpendicular to said height dimension with the fold-back tabs oriented in coplanar relation with the body portion and the suspension elements suspending the tab from a common rod of the rack.

7. In combination with a wire-type rack of a refrigerator case and the like, a merchandise information tag comprising a substantially planar body portion of sheet material having a height dimension, a width dimension, an upper edge portion defining a pair of fold-back tabs, fold means providing folding of the respective tabs about lines extending in a direction of said height dimension and a suspension element extending from an upper edge of each tab, said upper edge being perpendicular to said height dimension with the tabs folded back substantially at right angles to the body portion and the suspension elements suspending the tab from respective spaced rods of the rack.

* * * * *